US009708895B2

(12) United States Patent
Bassett

(10) Patent No.: US 9,708,895 B2
(45) Date of Patent: Jul. 18, 2017

(54) INTRAWELL FLUID INJECTION SYSTEM AND METHOD

(71) Applicant: Halliburton Energy Services, Inc., Houston, TX (US)

(72) Inventor: Lonnie Gene Bassett, Missouri City, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 361 days.

(21) Appl. No.: 14/222,815

(22) Filed: Mar. 24, 2014

(65) Prior Publication Data

US 2014/0332219 A1 Nov. 13, 2014

(30) Foreign Application Priority Data

May 7, 2013 (WO) ..... PCT/US2013/039951

(51) Int. Cl.
*E21B 43/16* (2006.01)
*E21B 43/12* (2006.01)
*E21B 43/14* (2006.01)

(52) U.S. Cl.
CPC ..... *E21B 43/162* (2013.01); *E21B 43/128* (2013.01); *E21B 43/14* (2013.01)

(58) Field of Classification Search
CPC ..... E21B 43/162; E21B 43/128; E21B 43/14; E21B 43/40; E21B 43/385
See application file for complete search history.

(56) References Cited

U.S. PATENT DOCUMENTS 4,296,810 A * 10/1981 Price ..... B01D 17/085 166/106
4,766,957 A * 8/1988 McIntyre ..... E21B 43/385 166/106
5,176,216 A * 1/1993 Slater ..... E21B 33/12 166/105.5
5,309,998 A * 5/1994 Rivas ..... E21B 43/38 166/105.5

(Continued)

FOREIGN PATENT DOCUMENTS

GB 2333538 A * 7/1999 ..... E21B 43/121

OTHER PUBLICATIONS

ISRWO, PCT/US2013/039951, KIPO, Jan. 27, 2014.

*Primary Examiner* — Jennifer H Gay

(57) ABSTRACT

An intrawell fluid injection system is operably positionable in a well having a production zone that is in fluid isolation from a discharge zone. The system includes an electric submersible pump assembly having an electric motor and a fluid pump that is operably associated with the electric motor. The fluid pump has a fluid intake operably positionable in fluid communication with the production zone. The fluid pump is operable to pump formation fluid from the production zone in a first axial direction. The system also includes a bypass assembly that is in downstream fluid communication with the electric submersible pump assembly. The bypass assembly is operable to transport formation fluid from the electric submersible pump assembly in a second axial direction that is opposite the first axial direction. The bypass assembly has a fluid discharge operably positionable in fluid communication with the discharge zone.

19 Claims, 3 Drawing Sheets

(56) References Cited

U.S. PATENT DOCUMENTS 5,425,416 A * 6/1995 Hammeke ..... E21B 41/0057 166/105.5
5,579,838 A * 12/1996 Michael ..... E21B 33/124 166/106
5,988,275 A * 11/1999 Brady ..... E21B 43/385 166/105.5
6,173,768 B1 1/2001 Watson
6,173,774 B1 1/2001 Fox
6,196,312 B1 * 3/2001 Collins ..... E21B 41/0057 166/106
7,635,030 B2 * 12/2009 Knight ..... E21B 43/38 166/106
7,896,079 B2 * 3/2011 Dyer ..... E21B 43/14 166/105
8,056,626 B2 11/2011 Murphy et al.
8,955,598 B2 * 2/2015 Brown ..... E21B 43/121 166/105.5
8,997,870 B2 * 4/2015 McAllister ..... E21B 43/385 166/265
2001/0050170 A1 12/2001 Woie et al.
2002/0179304 A1 * 12/2002 Michael ..... E21B 43/385 166/369
2008/0093085 A1 * 4/2008 Knight ..... E21B 43/38 166/369
2009/0065202 A1 * 3/2009 Brown ..... E21B 43/38 166/267
2009/0211755 A1 * 8/2009 Dyer ..... E21B 43/14 166/252.1
2012/0043088 A1 2/2012 McAllister et al.
2013/0068455 A1 * 3/2013 Brown ..... E21B 43/121 166/265
2014/0332219 A1 * 11/2014 Bassett ..... E21B 43/162 166/306
2015/0159472 A1 * 6/2015 Wolf ..... E21B 43/08 166/313

* cited by examiner

INTRAWELL FLUID INJECTION SYSTEM AND METHOD

CROSS-REFERENCE TO RELATED APPLICATIONS

This application claims the benefit under 35 U.S.C. §119 of the filing date of International Application No. PCT/US2013/039951, filed May 7, 2013.

TECHNICAL FIELD OF THE INVENTION

This invention relates, in general, to equipment utilized in conjunction with operations performed in relation to subterranean wells and, in particular, to the use of an intrawell fluid injection system to inject fluid from a production zone into a discharge zone without surfacing the fluid.

BACKGROUND OF THE INVENTION

Without limiting the scope of the present invention, its background is described with reference to producing water from a hydrocarbon bearing subterranean formation, as an example.

Most hydrocarbon bearing subterranean formations produce a mixture of oil and/or gas together with water, usually in the form of brine which may contain large amounts of dissolved minerals or precipitates such as salts. In fact, in some wells, water and other byproducts can be the majority of the total production yield, particularly during the later stages of production. Typically, once formation fluids are produced to the surface, the produced mixture undergoes a separation process where the hydrocarbon fluids are separated from the remaining components of the mixture and subsequently delivered to a refinery for treatment. In the separation process, the water and remaining components are usually removed from the hydrocarbon fluids using one or more single phase or multi-phase separation devices. Generally, these devices operate to agglomerate and coalesce the produced hydrocarbon fluids, thereby separating them from the water and other components of the produced mixture.

In certain operations, once the water is processed, it may be discharged into a body of water such as a surrounding ocean, in the case of offshore production. Before the water can be discharged into the ocean or any other body of water, however, it must first be rigorously tested to make sure that it does not contain any oil or other impurities that could damage the surrounding sea life. In addition, as environmental regulations increasingly become more stringent with respect to the disposal of produced water, it is crucial to obtain accurate and timely analysis of the separated fluids to avoid undesirable fines and/or fees.

One method to avoid disposal of produced water into the ocean or other body of water, is to inject the separated water and other components back into the ground. For example, the separated water produced from one well may be injected into a neighboring well. This process not only replaces a portion of the liquid removed from the reservoir, but also simultaneously serves to maintain required formation pressures for efficient production rates. It has been found, however, that the reinjection of the produced water into a neighboring well still requires surface processing and testing of the produced water. In addition, reinjection of the produced water into a neighboring well requires additional surface facilities including pumping and control systems as well as the drilling of a dedicated injection well, in some cases.

Therefore, a need has arisen for an improved system and method for disposal of water produced from a hydrocarbon bearing subterranean formation. A need has also arisen for such an improved system and method that does not involve the disposal of produced water into a body of water. Further, a need has arisen for such an improved system and method that does not require surface processing and reinjection of the produced water.

SUMMARY OF THE INVENTION

The present invention disclosed herein is directed to an intrawell fluid injection system and method for disposal of water produced from a subterranean formation. The intrawell fluid injection system and method of the present invention does not involve the disposal of produced water into a body of water. In addition, the intrawell fluid injection system and method of the present invention does not require surface processing and reinjection of the produced water.

In one aspect, the present invention is directed to an intrawell fluid injection system that is operably positionable in a well having a production zone that is in fluid isolation from a discharge zone. The system includes an electric motor, a fluid pump operably associated with the electric motor and a bypass assembly in downstream fluid communication with the fluid pump. The fluid pump has a fluid intake that is operably positionable in fluid communication with the production zone. The bypass assembly has a fluid discharge that is operably positionable in fluid communication with the discharge zone.

In one embodiment, at least one check valve assembly may be positioned in a fluid flow path between the intake and the discharge. In this embodiment, the check valve assembly may be operable to allow fluid flow from the fluid intake to the fluid discharge and operable to prevent fluid flow from the fluid discharge to the fluid intake. In certain embodiments, a sensor assembly may be operably positioned relative to the fluid flow path to measure a fluid flowrate therethrough. In some embodiments, axial fluid flow in the bypass assembly may be in a direction opposite of axial fluid flow in the fluid pump. In one embodiment, a gas separator may be operable to separate a gas fraction from the formation fluids of the production zone upstream of the bypass assembly. In another embodiment, a sample line in fluid communication with the bypass assembly may be used to supply fluid from the bypass assembly to a surface of the well for sampling.

In one embodiment, the bypass assembly may include an upper manifold operably positionable uphole of the electric motor and the fluid pump, a lower manifold operably positionable downhole of the electric motor and the fluid pump, and a plurality of bypass tubes extending between the upper and lower manifolds. In this embodiment, the bypass tubes may be circumferentially distributed around the bypass assembly. Also, in this embodiment, the bypass assembly may include a discharge tubing in downstream fluid communication with the lower manifold. This discharge tubing may include the fluid discharge. In addition, a seal assembly may be operably positioned between the discharge tubing and the well to provide isolation between the production zone and the discharge zone.

In another aspect, the present invention is directed to an intrawell fluid injection system that is operably positionable in a well having a production zone that is in fluid isolation from a discharge zone. The system includes an electric submersible pump assembly having an electric motor and a fluid pump that is operably associated with the electric motor. The fluid pump has a fluid intake operably positionable in fluid communication with the production zone. The fluid pump is operable to pump formation fluid from the production zone in a first axial direction. The system also includes a bypass assembly that is in downstream fluid communication with the electric submersible pump assembly. The bypass assembly is operable to transport formation fluid from the electric submersible pump assembly in a second axial direction that is opposite the first axial direction. The bypass assembly has a fluid discharge operably positionable in fluid communication with the discharge zone.

In a further aspect, the present invention is directed to an intrawell fluid injection method. The method includes providing an intrawell fluid injection system including an electric motor, a fluid pump and a bypass assembly; disposing the intrawell fluid injection system in a well having a production zone that is in fluid isolation from a discharge zone such that the fluid pump is in fluid communication with the production zone and the bypass assembly is in fluid communication with the discharge zone; operating the electric motor; pumping formation fluid from the production zone in a first axial direction with the fluid pump; receiving the formation fluid from the fluid pump in the bypass assembly; transporting the formation fluid in a second axial direction that is opposite the first axial direction in the bypass assembly; and discharging the formation fluid from the bypass assembly into the discharge zone.

The method may also include preventing reverse flow through the intrawell fluid injection system with at least one check valve; measuring a fluid flowrate through the intrawell fluid injection system with a sensor assembly; and/or separating a gas fraction from the formation fluids upstream of the bypass assembly with a gas separator.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
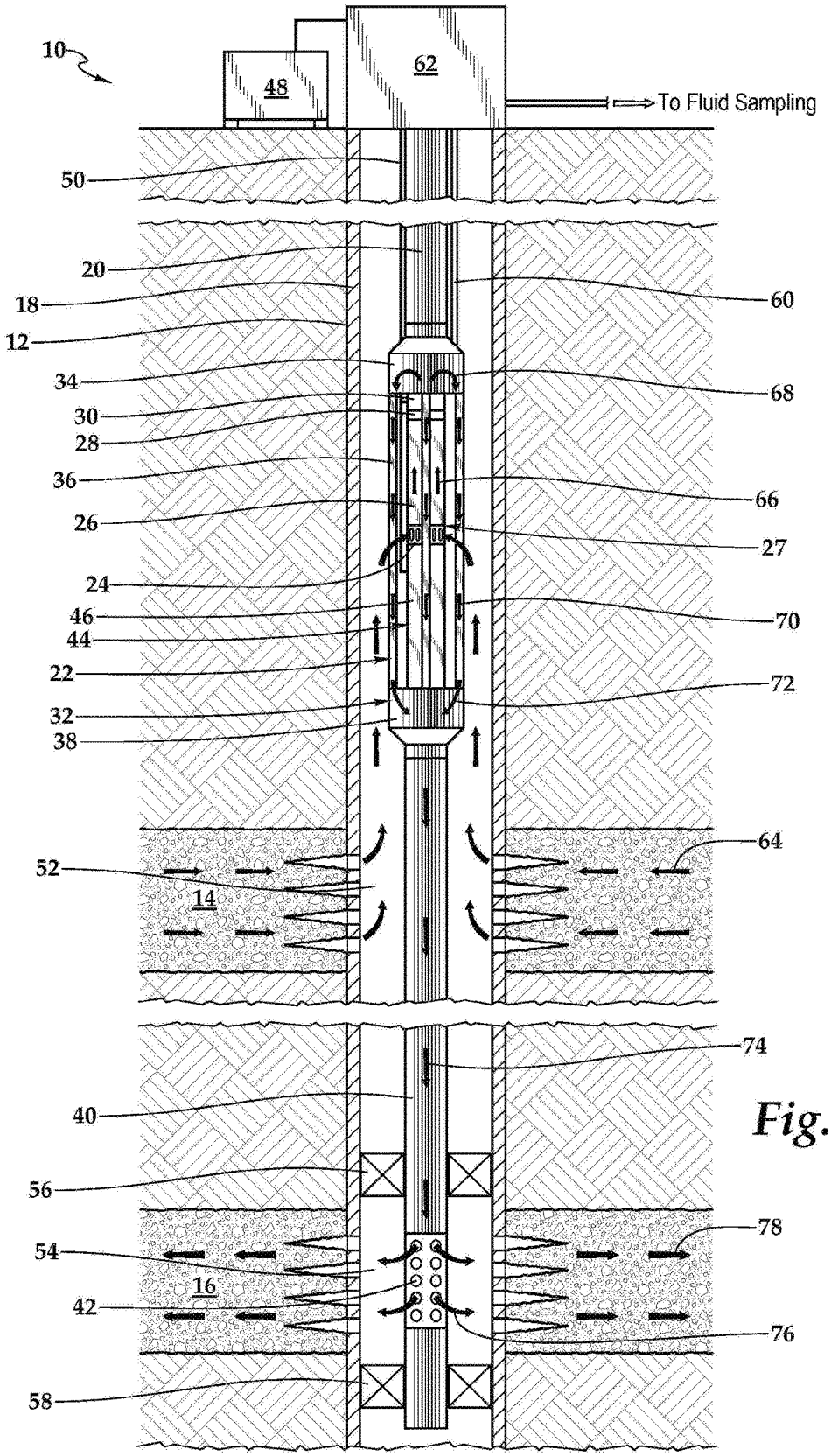
FIG. 1 is a schematic illustration of an intrawell fluid injection system positioned in a wellbore according to an embodiment of the present invention.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Referring initially to figure, an intrawell fluid injection system positioned in a well is schematically illustrated and generally designated 10. A wellbore 12 extends through the various earth strata including formation 14 and formation 16. A casing 18 is secured within wellbore 12. A tubing string 20 is disposed within wellbore 12. Tubing string 20 includes various tools for controlling fluid flow in wellbore 12 such as intrawell fluid injection system 22. In the illustrated embodiment, intrawell fluid injection system 22 includes a fluid intake subassembly 24, a fluid pump 26 having a fluid intake 27, a check valve assembly 28, a sensor subassembly 30 and a bypass assembly 32. Bypass assembly 32 includes an upper manifold 34, a plurality of bypass tubes 36, a lower manifold 38, a discharge tubing 40 and a fluid discharge subassembly 42. Preferably, fluid intake subassembly 24 and fluid pump 26 are part of an electric submersible pump assembly 44 that also includes, in the illustrated embodiment, an electric motor 46. Power, control signals and data may be sent between various components of electric submersible pump assembly 44 and a surface control system 48 via a cable assembly 50.

As illustrated, fluid intake subassembly 24 is in fluid communication with a production zone 52 associated with formation 14. Likewise, fluid discharge subassembly 42 is in fluid communication with a discharge zone 54 associated with formation 16. A seal assembly 56 is positioned between discharge tubing 40 and casing 18 in a location between production zone 52 and discharge zone 54 to provide isolation between production zone 52 and discharge zone 54. An optional seal assembly 58 is positioned between discharge tubing 40 and casing 18 downhole of discharge zone 54. In the illustrated embodiment, tubing string 20 provides support for intrawell fluid injection system 22 but does not provide a conduit for the transportation of fluids. Fluid samples, however, may be obtained at the surface via a sample line 60 that extends from upper manifold 34 to wellhead 62. Even though intrawell fluid injection system 22 has been described and depicted as having a particular array of components, it should be understood by those skilled in the art that other arrangements of components having a greater or lesser degree of functionality could alternatively be used without departing from the principles of the present invention.

When it is desired to inject fluid from formation 14 into formation 16, for example in a water flood operation, intrawell fluid injection system 22 of the present invention may be used. Operation of intrawell fluid injection system 22 is commenced responsive to power and control provided by surface control system 48 via a cable assembly 50. Specifically, power is supplied to electric motor 46 that is operable to turn the rotor and impeller elements in fluid pump 26. Operation of fluid pump 26 causes fluid from formation 14, represented by arrows 64 to enter fluid intake subassembly 24. The production fluid is then pumped in the uphole direction, as represented by arrows 66, by fluid pump 26. Check valve assembly 28 allows the production fluid to travel in the uphole direction upon exit from fluid pump 26 but prevents return flow therethrough. One or more sensors in sensor subassembly 30 may monitor various parameters of the production fluid such as pressure, temperature, pH, chemical composition, impurity content, viscosity, density, ionic strength, total dissolved solids, salt content, opacity, bacteria content, combinations thereof and the like as well as the flow rate of the production fluid such that the volume of production fluid injected by intrawell fluid injection system 22 may be determined. Even though check valve assembly 28 and sensor subassembly 30 have been depicted and described as being located between fluid pump 26 and upper manifold 34, it should be understood by those skilled in the art that check valve assembly 28, including multiple check valves, and sensor subassembly 30 could alternatively be located at any point along the flow path between fluid intake subassembly 24 and fluid discharge subassembly 42.

In the illustrated embodiment, after passing through sensor subassembly 30, the formation fluid enters upper manifold 34 that may include various fluid paths and/or valving arrangements for redirecting the formation fluid toward bypass tubes 36, as represented by arrows 68. The formation fluid then travels in the downhole direction, as represented by arrows 70, through bypass tubes 36. After passing through bypass tubes 36, the formation fluid enters lower manifold 38 that may include various fluid paths and/or valving arrangements for redirecting the formation fluid toward discharge tubing 40, as represented by arrows 72. The formation fluid, as represented by arrows 74, then travels in the downhole direction in discharge tubing 40. The formation fluid is discharged into discharge zone 54, as represented by arrows 76, and is injected into formation 16, as represented by arrows 78. In this manner, fluid from formation 14 can be injected into formation 16 using intrawell fluid injection system 22 of the present invention. It should be noted that intrawell fluid injection system 22 may be used to inject fluid from formation 14 into formation 16 even if the natural pressure in formation 14 is not sufficient the achieve this injection as fluid pump 26 provides the required pressure boost to enable such injection.

Advantageously, use of intrawell fluid injection system 22 of the present invention avoids the need to surface the production fluid, thereby avoiding the associated requirement of surface processing and testing of the produced fluid prior to disposal thereof. In addition, use of intrawell fluid injection system 22 of the present invention avoids the need for additional surface facilities required for reinjection operations as well as the need to drill dedicated injection wells. Further, use of intrawell fluid injection system 22 of the present invention prevents oxygen from entering the fluid stream thereby minimizing bacteria and scale formation.

Even though FIG. 1 depicts the present invention in a vertical wellbore, it should be understood by those skilled in the art that the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
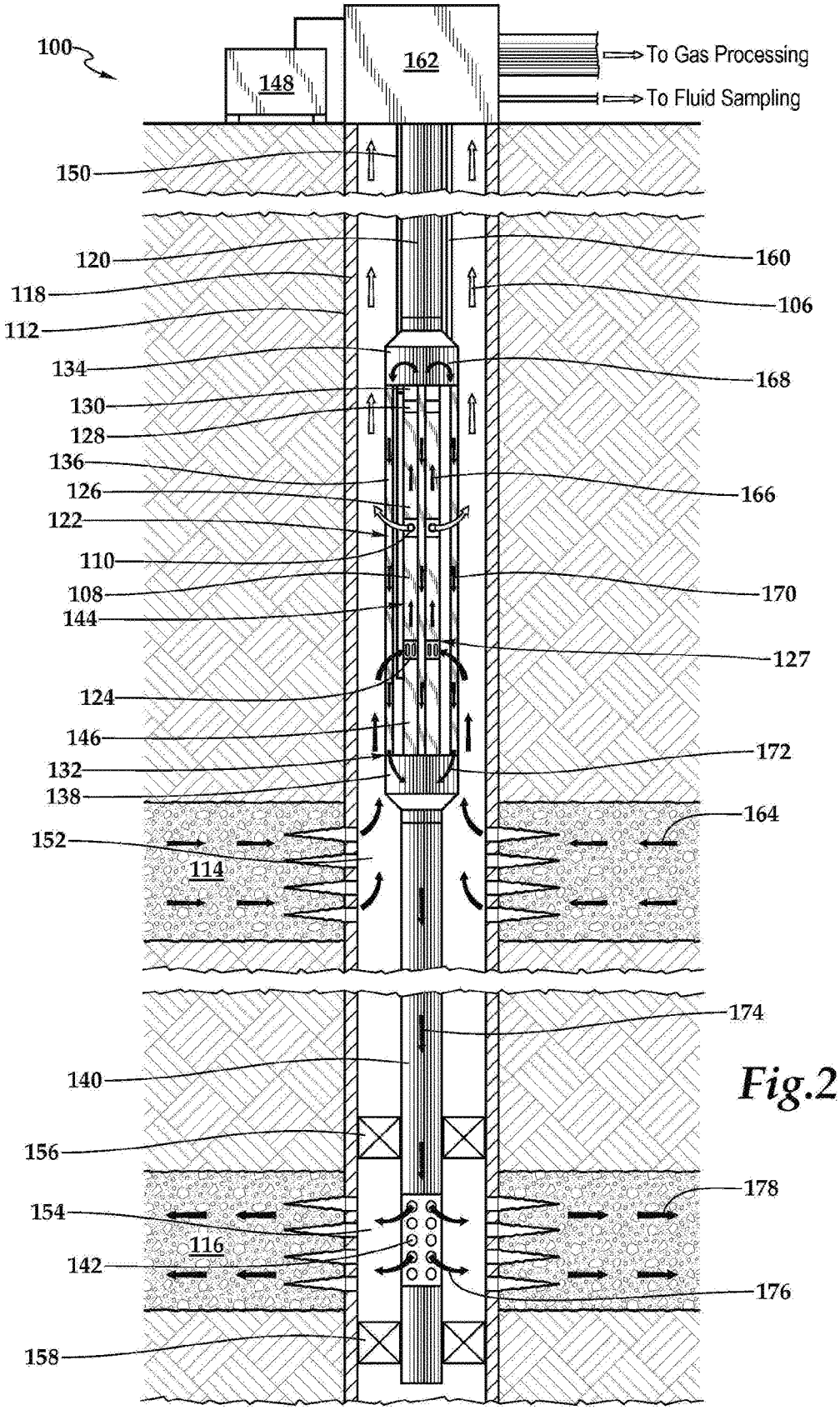
FIG. 2 is a schematic illustration of an intrawell fluid injection system positioned in a wellbore according to an embodiment of the present invention.

Referring next to FIG. 2, an intrawell fluid injection system positioned in a well is schematically illustrated and generally designated 100. A wellbore 112 extends through the various earth strata including formation 114 and formation 116. A casing 118 is secured within wellbore 112. A tubing string 120 is disposed within wellbore 112. Tubing string 120 includes various tools for controlling fluid flow in wellbore 112 such as intrawell fluid injection system 122. In the illustrated embodiment, intrawell fluid injection system 122 includes a fluid intake subassembly 124, a gas separator 108, a gas discharge subassembly 110, a fluid pump 126, a check valve assembly 128, a sensor subassembly 130 and a bypass assembly 132. Bypass assembly 132 includes an upper manifold 134, a plurality of bypass tubes 136, a lower manifold 138, a discharge tubing 140 and a fluid discharge subassembly 142. Preferably, fluid intake subassembly 124, fluid pump 126 having a fluid intake 127, gas separator 108 and gas discharge subassembly 110 are part of an electric submersible pump assembly 144 that also includes, in the illustrated embodiment, an electric motor 146. Power, control signals and data may be sent between various components of electric submersible pump assembly 144 and a surface control system 148 via a cable assembly 150.

As illustrated, fluid intake subassembly 124 is in fluid communication with a production zone 152 associated with formation 114. Likewise, fluid discharge subassembly 142 is in fluid communication with a discharge zone 154 associated with formation 116. A seal assembly 156 is positioned between discharge tubing 140 and casing 118 in a location between production zone 152 and discharge zone 154 to provide isolation between production zone 152 and discharge zone 154. An optional seal assembly 158 is positioned between discharge tubing 140 and casing 118 downhole of discharge zone 154. In the illustrated embodiment, tubing string 120 provides support for intrawell fluid injection system 122 but does not provide a conduit for the transportation of fluids. Fluid samples, however, may be obtained at the surface via a sample line 160 that extends from upper manifold 134 to wellhead 162.

When it is desired to inject fluid from formation 114 into formation 116, for example during coal bed degasification or gas production from a mature production zone, intrawell fluid injection system 122 of the present invention may be used. Operation of intrawell fluid injection system 122 is commenced responsive to power and control provided by surface control system 148 via a cable assembly 150. Specifically, power is supplied to electric motor 146 that is operable to turn the rotor of gas separator 108 and the rotor and impeller elements in fluid pump 126. Operation of fluid pump 126 causes fluid from formation 114, represented by arrows 164 to enter fluid intake subassembly 124. The production fluid is then processes in gas separator 108 which separates at least a portion of the gas fraction from the production fluid and discharges this gas portion via gas discharge subassembly 110, as represented by arrows 106. The gas portion is then produced to the surface for further processing. The remainder of the production fluid is then pumped in the uphole direction, as represented by arrows 166, by fluid pump 126. Check valve assembly 128 allows the production fluid to travel in the uphole direction upon exit from fluid pump 126 but prevents return flow therethrough. One or more sensors in sensor subassembly 130 may monitor various parameters of the production fluid such as pressure, temperature, pH, chemical composition, impurity content, viscosity, density, ionic strength, total dissolved solids, salt content, opacity, bacteria content, combinations thereof and the like as well as the flow rate of the production fluid such that the volume of production fluid injected by intrawell fluid injection system 122 may be determined. Even though check valve assembly 128 and sensor subassembly 130 have been depicted and described as being located between fluid pump 126 and upper manifold 134, it should be understood by those skilled in the art that check valve assembly 128, including multiple check valves, and sensor subassembly 130 could alternatively be located at any point along the flow path between fluid intake subassembly 124 and fluid discharge subassembly 142.

In the illustrated embodiment, after passing through sensor subassembly 130, the formation fluid enters upper manifold 134 that may include various fluid paths and/or valving arrangements for redirecting the formation fluid toward bypass tubes 136, as represented by arrows 168. The formation fluid then travels in the downhole direction, as represented by arrows 170, through bypass tubes 136. After passing through bypass tubes 136, the formation fluid enters lower manifold 138 that may include various fluid paths and/or valving arrangements for redirecting the formation fluid toward discharge tubing 140, as represented by arrows 172. The formation fluid, as represented by arrows 174, then travels in the downhole direction in discharge tubing 140. The formation fluid is discharged into discharge zone 154, as represented by arrows 176, and is injected into formation 116, as represented by arrows 178. In this manner, fluid from formation 114 can be injected into formation 116 using intrawell fluid injection system 122 of the present invention.

Figure 3:
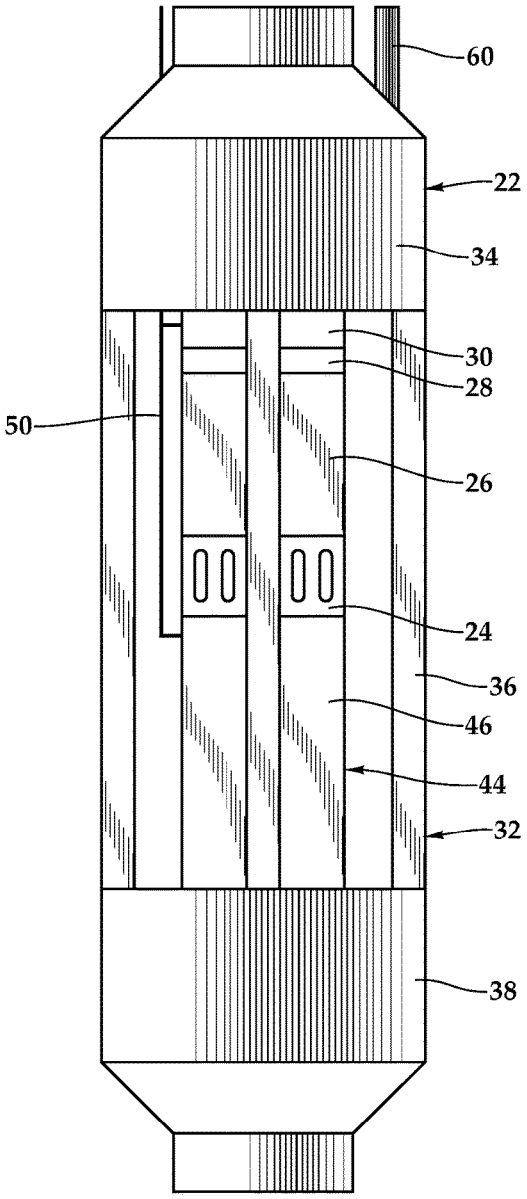
FIG. 3 is a schematic illustration of an exemplary intrawell fluid injection system according to an embodiment of the present invention.

Referring next to FIG. 3, an enlarged view of the intrawell fluid injection system 22 of FIG. 1 is depicted. Intrawell fluid injection system 22 includes electric submersible pump assembly 44 positioned in the center thereof. Electric submersible pump assembly 44 has a generally tubular outer housing and includes electric motor 46, fluid intake subassembly 24 and fluid pump 26. Also positioned in the center of intrawell fluid injection system 22 is check valve assembly 28 and sensor subassembly 30. As described above, check valve assembly 28 and sensor subassembly 30 could alternatively be positioned in other locations in the fluid flow path through intrawell fluid injection system 22. Power, control signals and data may be sent between a surface control system (not pictured) and the various components of electric submersible pump assembly 44, such as electric motor 46 and sensor subassembly 30, via a cable assembly 50.

Intrawell fluid injection system 22 also includes bypass assembly 32 that is positioned above, below and around electric submersible pump assembly 44. In the illustrated embodiment, bypass assembly 32 includes an upper manifold 34 positioned above electric submersible pump assembly 44, a lower manifold 38 positioned below electric submersible pump assembly 44 and a plurality of bypass tubes 36 positioned around electric submersible pump assembly 44. As illustrated, bypass assembly 32 includes four bypass tubes 36 (only three of which are visible in FIGS. 1 and 3) that extend between upper manifold 34 and lower manifold 38 and are circumferentially distributed about bypass assembly 32. Even though FIGS. 1 and 3 have described and depicted bypass assembly 32 as having a particular number of bypass tubes, it should be understood by those skilled in the art that a bypass assembly of the present invention may alternatively have any number of bypass tubes both greater than or less than that shown. Bypass assembly 32 includes a sample line 60 that may extend to the surface to enable fluid sampling of production fluid from intrawell fluid injection system 22. As described above, intrawell fluid injection system 22 is operable to be connected within a tubing string such that the portion of the tubing string above intrawell fluid injection system 22 does not transport fluid while the portion of the tubing string below intrawell fluid injection system 22 transports the production fluid to the discharge zone.

Figure 4:
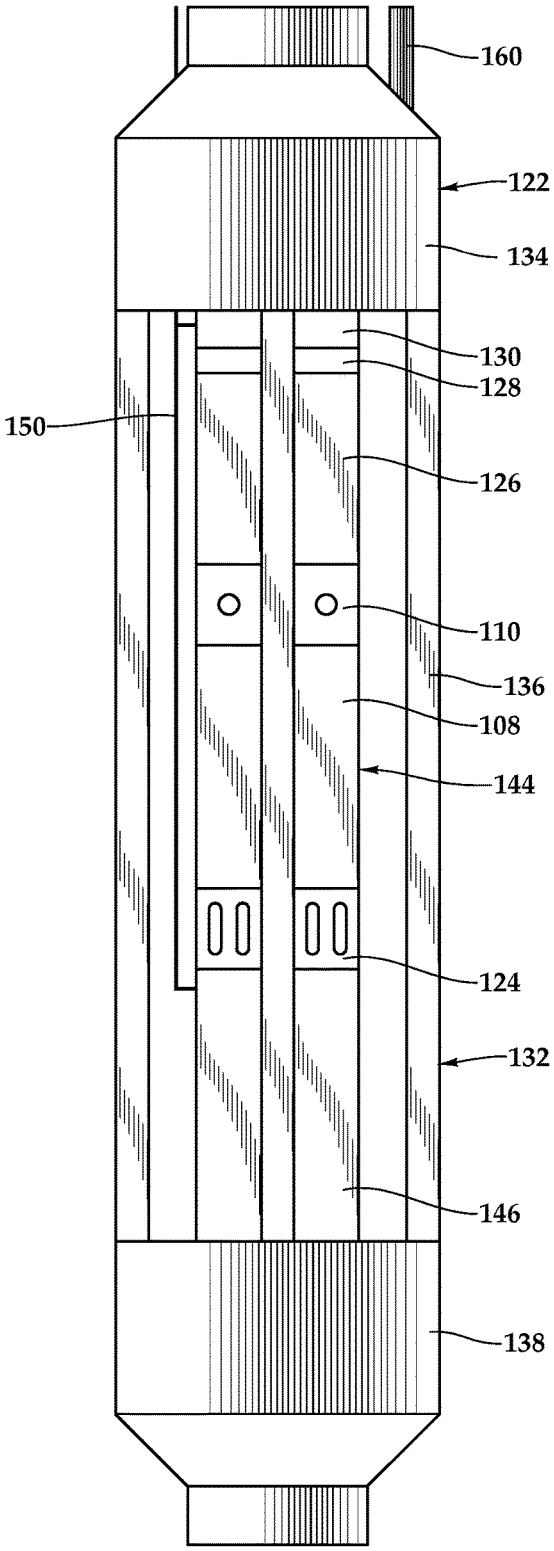
FIG. 4 is a schematic illustration of an exemplary intrawell fluid injection system according to an embodiment of the present invention.

Referring next to FIG. 4, an enlarged view of the intrawell fluid injection system 122 of FIG. 2 is depicted. Intrawell fluid injection system 122 includes electric submersible pump assembly 144 positioned in the center thereof. Electric submersible pump assembly 144 has a generally tubular outer housing and includes electric motor 146, fluid intake subassembly 124, gas separator 108, gas discharge subassembly 110 and fluid pump 126. Also positioned in the center of intrawell fluid injection system 122 is check valve assembly 128 and sensor subassembly 130. Power, control signals and data may be sent between a surface control system (not pictured) and the various components of electric submersible pump assembly 144, such as electric motor 146 and sensor subassembly 130, via a cable assembly 150.

Intrawell fluid injection system 122 also includes bypass assembly 132 that is positioned above, below and around electric submersible pump assembly 144. In the illustrated embodiment, bypass assembly 132 includes upper manifold 134 positioned above electric submersible pump assembly 144, lower manifold 138 positioned below electric submersible pump assembly 144 and a plurality of bypass tubes 136 positioned around electric submersible pump assembly 144. As illustrated, bypass assembly 132 includes four bypass tubes 136 (only three of which are visible in FIGS. 2 and 4) that extend between upper manifold 134 and lower manifold 138 and are circumferentially distributed about bypass assembly 132. Even though FIGS. 2 and 4 have described and depicted bypass assembly 132 as having a particular number of bypass tubes, it should be understood by those skilled in the art that a bypass assembly of the present invention may alternatively have any number of bypass tubes both greater than or less than that shown. Bypass assembly 132 includes sample line 160 that may extend to the surface to enable fluid sampling of production fluid from intrawell fluid injection system 122. As described above, intrawell fluid injection system 122 is operable to be connected within a tubing string such that the portion of the tubing string above intrawell fluid injection system 122 does not transport fluid while the portion of the tubing string below intrawell fluid injection system 122 transports the production fluid to the discharge zone.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An intrawell fluid injection system operably positionable in a well having a production zone that is in fluid isolation from a discharge zone, the system comprising:

an electric motor;

a fluid pump operably associated with the electric motor, the fluid pump having a fluid intake operably positionable in fluid communication with the production zone;

a gas separator in fluid communication with the fluid intake of the pump, the gas separator operable to separate a gas fraction from the formation fluids pumped from the production zone;

a bypass assembly in downstream fluid communication with the gas separator, the bypass assembly having a fluid discharge operably positionable in fluid communication with the discharge zone; and a sample line fluidly coupled to the bypass assembly between the gas separator and the fluid discharge, the sample line extending to the surface to enable fluid sampling of production fluid in transport to the discharge zone.

2. The system as recited in claim 1 further comprising at least one check valve assembly positioned in a fluid flow path between the intake and the discharge, the check valve assembly operable to allow fluid flow from the fluid intake to the fluid discharge and prevent fluid flow from the fluid discharge to the fluid intake.

3. The system as recited in claim 2 further comprising a sensor assembly operably positioned relative to the fluid flow path and operable to measure a fluid flowrate therethrough.

4. The system as recited in claim 1 wherein axial fluid flow in the bypass assembly is in a direction opposite of axial fluid flow in the fluid pump.

5. The system as recited in claim 1 wherein the bypass assembly further comprises an upper manifold operably positionable uphole of the electric motor and the fluid pump, a lower manifold operably positionable downhole of the electric motor and the fluid pump, and a plurality of bypass tubes extending between the upper and lower manifolds.

6. The system as recited in claim 5 wherein the bypass tubes are circumferentially distributed around the bypass assembly.

7. The system as recited in claim 5 wherein the bypass assembly further comprises a discharge tubing in downstream fluid communication with the lower manifold and including the fluid discharge.

8. The system as recited in claim 7 further comprising a seal assembly operably positionable between the discharge tubing and the well to provide isolation between the production zone and the discharge zone.

9. The system as recited in claim 1 wherein the system is connected within a tubing string such that a portion of the tubing string uphole of the system is fluidly isolated from the system.

10. An intrawell fluid injection system operably positionable in a well having a production zone that is in fluid isolation from a discharge zone, the system comprising:

an electric submersible pump assembly including an electric motor and a fluid pump operably associated with the electric motor, the fluid pump having a fluid intake operably positionable in fluid communication with the production zone, the fluid pump operable to pump formation fluid from the production zone in a first axial direction;

a gas separator in fluid communication with the fluid intake of the pump, the gas separator operable to separate a gas fraction from the formation fluids pumped from the production zone;

a bypass assembly in downstream fluid communication with a gas separator, the bypass assembly operable to transport formation fluid from the gas separator in a second axial direction that is opposite the first axial direction, the bypass assembly having a fluid discharge operably positionable in fluid communication with the discharge zone; and a sample line fluidly coupled to the bypass assembly between the gas separator and the fluid discharge, the sample line extending to the surface to enable fluid sampling of production fluid in transport to the discharge zone.

11. The system as recited in claim 10 further comprising at least one check valve assembly positioned in a fluid flow path between the intake and the discharge, the check valve assembly operable to allow fluid flow from the fluid intake to the fluid discharge and prevent fluid flow from the fluid discharge to the fluid intake.

12. The system as recited in claim 11 further comprising a sensor assembly operably positioned relative to the fluid flow path and operable to measure a fluid flowrate therethrough.

13. The system as recited in claim 10 wherein the bypass assembly further comprises an upper manifold operably positionable uphole of the electric submersible pump assembly, a lower manifold operably positionable downhole of the electric submersible pump assembly and a plurality of bypass tubes extending between the upper and lower manifolds.

14. The system as recited in claim 13 wherein the bypass tubes are circumferentially distributed around the bypass assembly.

15. The system as recited in claim 13 wherein the system is connected within a tubing string such that the tubing string uphole of the of the system does not transport fluid.

16. An intrawell fluid injection method comprising:

providing an intrawell fluid injection system including an electric motor, a fluid pump and a bypass assembly;

disposing the intrawell fluid injection system in a well having a production zone that is in fluid isolation from a discharge zone such that the fluid pump is in fluid communication with the production zone and the bypass assembly is in fluid communication with the discharge zone;

operating the electric motor;

pumping formation fluid from the production zone in a first axial direction with the fluid pump;

separating a gas fraction from the formation fluids downstream of the fluid pump intake with a gas separator;

receiving the formation fluid from the fluid pump in the bypass assembly;

transporting the formation fluid in a second axial direction that is opposite the first axial direction in the bypass assembly;

discharging the formation fluid from the bypass assembly into the discharge zone;

taking a sample of the formation fluid in transport to the discharge zone from the bypass assembly; and delivering the sample to the surface through a sample line extending to the surface from the bypass assembly between the gas separator and the fluid discharge.

17. The method as recited in claim 16 further comprising preventing reverse flow through the intrawell fluid injection system with at least one check valve.

18. The method as recited in claim 16 further comprising measuring a fluid flowrate through the intrawell fluid injection system with a sensor assembly.

19. The method as recited in claim 16 further comprising connecting the system within a tubing string and fluidly isolating the system from a portion of the tubing string uphole of the system.

* * * * *